US008467537B2

(12) United States Patent
Lloyd et al.

(10) Patent No.: US 8,467,537 B2
(45) Date of Patent: Jun. 18, 2013

(54) APPARATUS AND METHOD FOR CONNECTING A HEARING AID TO HEARING AID TEST EQUIPMENT

(75) Inventors: Douglas Lloyd, Ballaral (AU); Matthew Callaway, Darwin (AU)

(73) Assignee: Audiology Innovations Pty Ltd (AU)

( * ) Notice: Subject to any disclaimer, the term of this patent is extended or adjusted under 35 U.S.C. 154(b) by 1090 days.

(21) Appl. No.: 12/227,662

(22) PCT Filed: May 24, 2007

(86) PCT No.: PCT/AU2007/000715

§ 371 (c)(1),
(2), (4) Date: Apr. 16, 2009

(87) PCT Pub. No.: WO2007/134403

PCT Pub. Date: Nov. 29, 2007

(65) Prior Publication Data

US 2009/0316921 A1 Dec. 24, 2009

(30) Foreign Application Priority Data

May 24, 2006 (AU) ..... 2006902794

(51) Int. Cl.
*H04R 29/00* (2006.01)

(52) U.S. Cl.
USPC ..... 381/60

(58) Field of Classification Search
USPC ..... 381/60, 328; 73/585
See application file for complete search history.

(56) References Cited

U.S. PATENT DOCUMENTS

| | | | | |
|---|---|---|---|---|
| 3,979,567 | A | 9/1976 | Frye | |
| 2001/0033664 | A1 | 10/2001 | Poux et al. | |
| 2007/0036379 | A1 * | 2/2007 | Anderson et al. | 381/324 |

FOREIGN PATENT DOCUMENTS

| | | | |
|---|---|---|---|
| EP | 1 333 701 | A2 | 8/2003 |

* cited by examiner

*Primary Examiner* — Calvin Lee
*Assistant Examiner* — Scott Stowe
(74) *Attorney, Agent, or Firm* — Lerner, David, Littenberg, Krumholz & Mentlik, LLP

(57) ABSTRACT

The invention includes an apparatus for connecting a hearing aid tester to a sound emitting portion of a hearing aid that fits into the concha or ear canal of a user, the apparatus including a body having a front end and a rear end, a passage within the body for receiving the sound emitting portion and extending from an opening near the front end to an opening near the rear end, the opening near the front end for connecting the passage to the hearing aid tester, and a resilient surface within the passage that resiliently deforms when the sound emitting portion is received in the passage for retaining the sound emitting portion in the passage. The invention also includes a method of forming the apparatus and a method of testing a hearing aid having a sound emitting portion that fits into the concha or ear canal of a user.

22 Claims, 7 Drawing Sheets

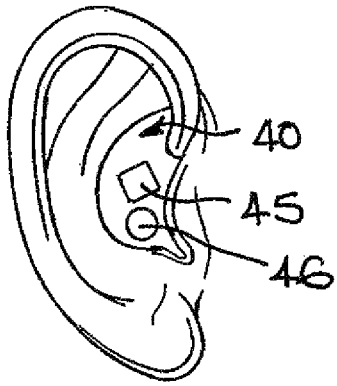
FIG 13
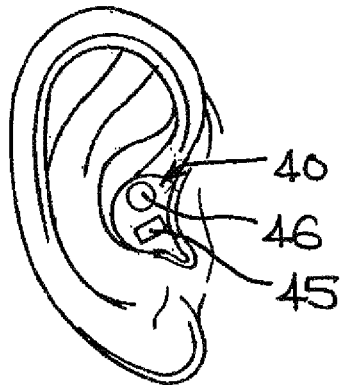
FIG 14
FIG 15
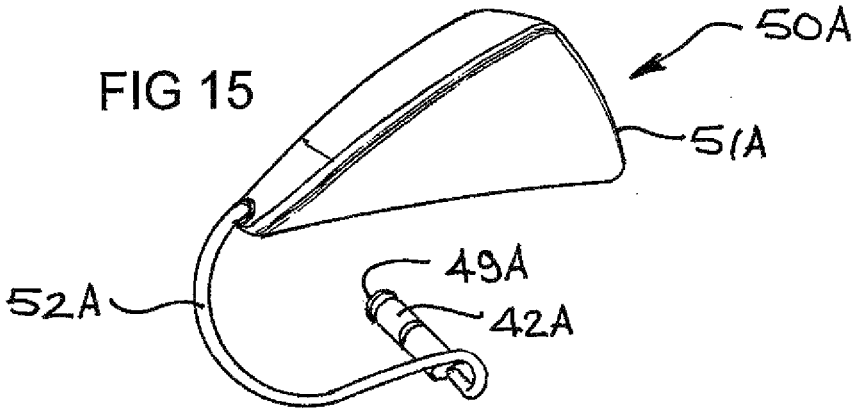
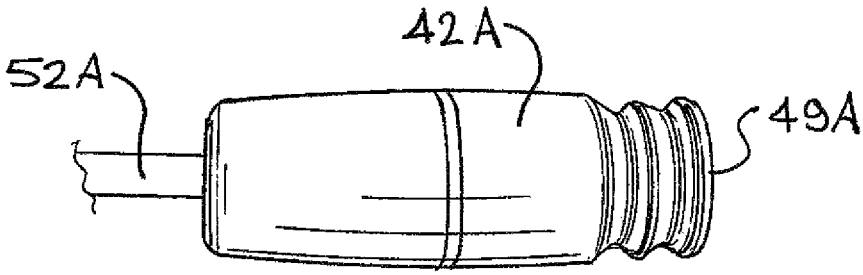
FIG 16

APPARATUS AND METHOD FOR CONNECTING A HEARING AID TO HEARING AID TEST EQUIPMENT

FIELD OF THE INVENTION

This invention relates to hearing aids and is particularly suitable for use with air conduction hearing aids of the In The Ear (ITE), In The Canal (ITC), Mini Canal (MC), Completely In Canal (CIC) and Receiver In The Ear (RITE) types that include a sound emitting portion that fits into the concha or ear canal of a user. The present invention is suitable for connecting the sound emitting portion of such hearing aids to conventional hearing aid testing and/or analysing equipment.

BACKGROUND OF THE INVENTION

The following discussion of the background of the invention is intended to facilitate an understanding of the invention. However, it should be appreciated that the discussion is not an acknowledgement or admission that any of the material referred to was published, known or part of the common general knowledge as at the priority date of the application.

A hearing aid is a device used in some forms of deafness to amplify sound before it reaches the auditory organs. Modern hearing aids are electronic and generally comprise a small electronic apparatus that amplifies sound and is worn in or behind the ear to compensate for impaired hearing. They contain a tiny receiver and a transistor amplifier, and are usually battery powered. Some are small enough to fit into the outer ear.

There are three main types of conventional hearing aid. One is the bone-conduction hearing aid. This hearing aid is placed behind the ear and channels sound waves to the adjacent bony part of the skull, which then transmits the vibrations to the auditory nerve of the cochlea. Another main type of hearing aid is the air-conduction hearing aid. This hearing aid amplifies sounds and directs them into the ear toward the tympanic membrane. In recent years, a number of advancements have been made to hearing aids, improving the comfort, sensitivity, and aesthetic quality of the devices. Today, many hearing aids are customized to amplify only those noises (e.g., high frequency) that the user has difficulty hearing. The last main type of hearing aid is the cochlear implant. This type of device has been developed for use by certain severely-profoundly deaf people. They consist of mechanical replacements for ineffective hair cells in the inner ear, which transform sound vibrations into electronic impulses that stimulate the auditory nerve.

Of the air conduction type of hearing aid there are a number of variations of this aid. One such aid is referred to as the Behind The Ear (BTE) aid. This type of aid has a small case that fits behind the ear and conducts and amplifies sound from a directional microphone to the ear canal through an earmold that is custom made. BTEs can be used for mild to profound hearing losses.

Another such air conduction hearing aid is referred to as the In The Ear (ITE) aid. This device fits in the outer bowl of the ear (called the concha) and is sometimes visible when standing face to face with someone. ITE hearing aids are custom made to fit each individual's ear. They can be used in mild to some severe hearing losses. Squealing or whistling caused by sound leaking out of the aid and being amplified again, may be a problem for severe hearing losses. Some modern circuits are able to provide feedback regulation or cancellation to assist with this.

Further variations of the air conduction hearing aid include devices referred to as In The Canal (ITC), Mini Canal (MC) and Completely In Canal (CIC) aids. ITC aids are smaller, filling only the bottom half of the external ear. One usually cannot see very much of this hearing aid when face to face with someone wearing the device. MC and CIC aids are even smaller and are often not visible unless one looks directly into the wearer's ear. They can be used for mild to moderate hearing losses.

Another air conduction hearing aid is referred to as an Open-Fit or Over The Ear (OTE) hearing aid. Usually quite discreet, these are small Behind The Ear (BTE) type devices, with a much finer clear tube that runs down into the ear canal. Inside the ear canal, there is a small soft silicone dome or a moulded acrylic tip that holds the tube in place. There are also devices available which have an external speaker, placed inside the ear canal, and connected to the hearing system itself by a thin cable. Inside the ear canal, there is a small soft silicone dome or a moulded acrylic tip that houses the receiver and holds it in place in the ear canal. Such devices are referred to as Receiver In The Ear (RITE) hearing aids. In these devices, the external speaker allows the apparatus behind the ear to be even smaller.

In The Ear (ITE), In The Canal (ITC), Mini Canal (MC) and Completely In Canal (CIC) type hearing aids have a shell shaped body containing a microphone, amplifier, and receiver. The receiver is a loudspeaker that generates sound in the user's ear canal. One end of the shell type body has a faceplate that includes a battery door, on/off switch, volume control (if available), and microphone opening. Most of the shells for each of these aids are made from ear mold impressions taken from the ear canal and/or concha of the user who will wear the hearing aid. Accordingly, the shell shaped body, which has been moulded to fit the shape of the user's ear canal and/or concha, is inserted into the ear of the user and fits snugly in the user's ear canal and/or concha. The end of the shell shaped body opposite the faceplate has an aperture through which sound generated by the receiver passes into the user's ear canal. Receiver In The Ear (RITE) hearing aids also have a shell shaped body containing a microphone and amplifier. However, the receiver is placed inside the ear canal and is connected to the body by a thin cable. Inside the ear canal, there is a small soft silicone dome or a moulded acrylic tip that houses the receiver and holds it in place in the ear canal.

A hearing professional conducts various audiologic tests including pure-tone thresholds, speech reception thresholds, and speech discrimination scores to define the type, degree, and configuration of hearing loss. In addition, most comfortable loudness and uncomfortable loudness level tests help in determining the patient's dynamic range. All the above tests are used to determine suitable specifications for a user's hearing aid such as frequency response curve, gain, and maximum output.

The functional parameters of a hearing aid such as gain, output, and frequency response can be measured using a standardised test box analyser or tester such as, for example, a Madsen Electronics "Aurical". This example of a relatively standard hearing aid tester includes a microphone connected via a cable to the measuring device at one end and to a 2-$cm^3$ (2 cc) metal coupler, or any other equivalent device that simulates an ear canal and ear drums, at the other end. The hearing aid is connected to the coupler and the tester tests the performance of the hearing aid such as frequency response, gain, and maximum output of the hearing aid. The coupler simulates the condition of the aid in an ear, but many differences exist between a metal 2-$cm^3$ coupler and the volume and texture of various ear canals and eardrums. Because of these differences, a Real Ear probe-tube measurement is sometimes used to reveal the exact frequency response, gain, and maximum output of the hearing aid in the ear at the site of the eardrum. However, this type of test is not always suitable. It is a difficult test to administer and it is not always possible to insert and maintain an ear probe-tube in the ear of a young child.

Another major problem with a hearing aid tester incorporating a 2-$cm^3$ metal coupler is that it is difficult to marry the sound emitting portion of a hearing aid that is shaped like the concha or ear canal of a person to a fixed shape metal 2-$cm^3$ coupler. For the hearing aid tester to provide accurate, reliable and repeatable tests results the sound emitting portion of the hearing aid must be able to be connected or retained to the metal 2-$cm^3$ coupler with sound emitting portion oriented and located in a precise position relative to the 2-$cm^3$ metal coupler. Effectively, the hearing professional needs to be able to reliably and repeatably replicate the constant relative position of the sound emitting portion relative to the concha and/or ear canal and/or ear drum of the user. In other words, the user's ear concha and/or ear canal shape, configuration and orientation remains constant even after repeated insertion and removal of the hearing aid and, as such, the hearing aid test equipment needs to be able to replicate this feature of the human ear. It is also preferable if there is an air tight seal between the concha or ear canal shaped sound emitting portion of the hearing aid and the coupler in the case of some forms of hearing aid inserted in the concha and/or ear canal.

At present, hearing professionals use a pliable putty type adhesive material to attempt to retain the sound emitting portion to the 2-$cm^3$ metal coupler that in turn is connected the hearing aid tester. One problem with this is that the putty material may not reliably retain the sound emitting portion to the coupler. Another problem is that each time a sound emitting portion of a hearing aid is retained by the pliable adhesive putty to the coupler the relative position and/or orientation of the sound emitting portion to the coupler, which is simulating the structure of the concha and/or ear canal, varies to an uncontrollable degree. Also, key structures of the hearing aid that affect particular components of the response of the hearing aid, such as vents, may be occluded. Because of these variable factors the results provided by the test equipment may be inaccurate and inconsistent. At present, the hearing professional must use their skill and experience to make an educated guess to compensate for this variability in results associated with the shortcomings of available hearing aid test equipment and the 2 cc coupler discussed above.

Accordingly, it would be advantageous to provide an apparatus for connecting a sound emitting portion of a hearing aid that fits into the concha or ear canal of a user such as, but not limited to, any one or more of the In The Ear (ITE), In The Canal (ITC), Mini Canal (MC), Completely In Canal (CIC), Receiver In The Ear (RITE), and Over The Ear (OTE) type hearing aids, to a 2 cc coupler and a hearing aid tester, or any other equivalent device that simulates an ear canal and ear drums, that provides any one or more of the following: effectively and securely receiving and retaining the sound emitting portion of the hearing aid; reliably and repeatably locating and/or orienting the sound emitting portion of the hearing aid relative to the test equipment, and in particular the microphone associated with the test equipment; providing a practical seal between the sound emitting portion of the hearing aid and the test equipment. It would also be advantageous to provide an apparatus that may also enable hearing aid test equipment to more accurately simulate the condition of the hearing aid in the concha or ear canal of a user such that results provided by the hearing aid test equipment may be more accurate in testing the hearing aid.

SUMMARY OF THE INVENTION

Accordingly, in a first aspect the present invention provides an apparatus for connecting a hearing aid tester to a sound emitting portion of a hearing aid that fits into the concha or ear canal of a user. The apparatus includes a body having a front end and a rear end and a passage within the body for receiving the sound emitting portion and extending from an opening near the front end to an opening near the rear end, the opening near the front end for connecting the passage to the hearing aid tester. The apparatus also includes a resilient surface within the passage that resiliently deforms when the sound emitting portion is received in the passage for retaining the sound emitting portion in the passage.

In one form, the passage includes a sound emitting portion receiving section immediately adjacent the rear end of the body, the sound emitting portion receiving section being at least partially defined by the resilient surface. The sound emitting portion receiving section of the passage may be dimensioned to receive the sound emitting portion in interference fit.

In another form, the resilient surface may be integral with the sound emitting portion receiving section of the passage, whereas, in another form a resilient insert within the passage resiliently deforms when the sound emitting portion is received in the passage.

The sound emitting portion receiving section of the passage may be shaped like the internal surface of a concha or ear canal for receiving the sound emitting portion of any one or more of In The Ear (ITE), In The Canal (ITC), Mini Canal (MC), Completely In Canal (CIC) and Behind The Ear (BTE) type hearing aids. The sound emitting portion receiving section of the passage may also be shaped for receiving the sound emitting portion of either or both of Receiver In The Ear (RITE) and Over The Ear type hearing aids.

In one form, the hearing aid tester includes an ear volume simulating device and the passage includes a simulating device receiving section immediately adjacent the front end of the body for receiving the simulating device in the passage. The simulating device receiving section may have at one end the opening near the front end of the body and at another end the sound emitting portion receiving section of the passage, wherein the simulating device is received through the opening near the front end. A resilient surface may be included within the simulating device receiving section of the passage that resiliently deforms when the simulating device is received in the passage for retaining the simulating device in the passage. Also, the simulating device receiving section of the passage may dimensioned to receive the simulating device in interference fit.

In another form, the passage may include an ear volume simulating section immediately adjacent the front end of the body, the simulating section of the passage having an internal void volume for simulating a void volume of an ear. The simulating section may have at one end the opening near the front end of the body for receiving a microphone portion of the hearing aid tester. The simulating section may also be a 2 cc coupler.

In one form, the passage may be defined by a resilient surface extending from the opening near the front end to the opening near the rear end. In another form, the body may be formed from a resilient material such as an elastomer.

In yet another form, the sound emitting portion receiving section of the passage may be shaped to conform to the shape of the sound emitting portion of the hearing aid. The sound emitting portion receiving section of the passage may also provide a practical seal between the sound emitting portion and the hearing aid tester.

The above aspect of the invention is advantageous in that it provides an apparatus that may enable connecting a hearing aid tester to a hearing aid having a sound emitting portion that is placed inside the concha or ear canal such as In The Ear (ITE), In The Canal (ITC), Mini Canal (MC), Completely In Canal (CIC), Receiver In The Ear (RITE) and Over The Ear (OTE) type hearing aids. The invention is advantageous in that it also provides an apparatus that may achieve any one or more of the following: effectively and securely receiving and retaining the sound emitting portion of the hearing aid; reliably and repeatably locating and/or orienting the sound emitting portion of the hearing aid relative to the test equipment, and in particular the microphone associated with the test equipment; providing a practical seal between the sound emitting portion of the hearing aid and the test equipment. The invention may also be beneficial in providing an apparatus that enables hearing aid test equipment to more accurately simulate the condition of the hearing aid in the concha or ear canal of a user such that results provided by the hearing aid test equipment may be more accurate in testing the hearing aid.

In another aspect, the invention provides a method of testing a hearing aid having a sound emitting portion that fits into the concha or ear canal of a user, the method including the steps of:

providing an apparatus including: a body having front end and a rear end; a passage within the body for receiving the sound emitting portion and extending from an opening near the front end to an opening near the rear end, the opening near the front end for connecting the passage to the hearing aid tester; and a resilient surface within the passage that resiliently deforms when the sound emitting portion is received in the passage for retaining the sound emitting portion in the passage, as defined in any one of the preceding claims;

inserting the sound emitting portion in the passage; and connecting the opening near the front end to the hearing aid tester.

In yet another aspect, the invention provides a method of forming an apparatus for connecting a hearing aid tester to a sound emitting portion of a hearing aid that fits into the concha or ear canal of a user, the method including:

providing a first mould shaped like an internal surface of a concha or an ear canal or like an external surface of the sound emitting portion;

placing the first mould in a void within a second mould that is shaped to form a volume around the first mould;

filling the volume around the first mould with a flowable material that hardens to form a body having front end and a rear end; a passage within the body for receiving the sound emitting portion and extending from an opening near the front end to an opening near the rear end, the opening near the front end for connecting the passage to the hearing aid tester; and providing a resilient surface within the passage that resiliently deforms when the sound emitting portion is received in the passage for retaining the sound emitting portion in the passage.

In one form, the step of providing the resilient surface within the passage includes filling the volume around the first mould with flowable material that hardens to form a resiliently deformable surface within the passage.

In another form, the step of providing the resilient surface within the passage includes placing a resilient insert within the passage that resiliently deforms when the sound emitting portion is received in the passage.

The step of providing the first mould shaped like the internal surface of a concha or an ear canal or like an external surface of the sound emitting portion may include taking a cast of the shape of the internal surface of the concha or the ear canal or the external surface of the sound emitting portion and forming the first mould from the cast.

In one form, the void within the second mould is shaped to form a section of the passage immediately adjacent the front end of the body that is adapted to receive an ear volume simulating device. The second mould may be shaped so that the apparatus will fit into a recording test box of the hearing aid tester.

BRIEF DESCRIPTION OF THE DRAWINGS

It will be convenient to hereinafter describe the invention in greater detail by reference to the accompanying drawings which show and existing means of connecting a sound emitting portion of a hearing aid to a 2 cc coupler and a hearing aid tester as well as preferred embodiments of the invention. The particularity of the drawings and the related detailed description is not to be understood as superseding the generality of the preceding broad description of the invention.

FIG. 13 shows an In-The-Ear (ITE) type hearing aid placed in an ear;

FIG. 14 shows an In-The-Canal (ITC) type hearing aid placed in an ear.

FIG. 15 shows a Receiver In The Ear (RITE) type hearing aid having a shell shaped body containing a microphone and amplifier that is worn behind the ear and a receiver in a housing that is placed inside the ear canal and is connected to the body by a thin cable.

FIG. 16 shows the receiver housing of the Receiver In The Ear (RITE) type hearing aid having of FIG. 14.

DETAILED DESCRIPTION

Figure 1:
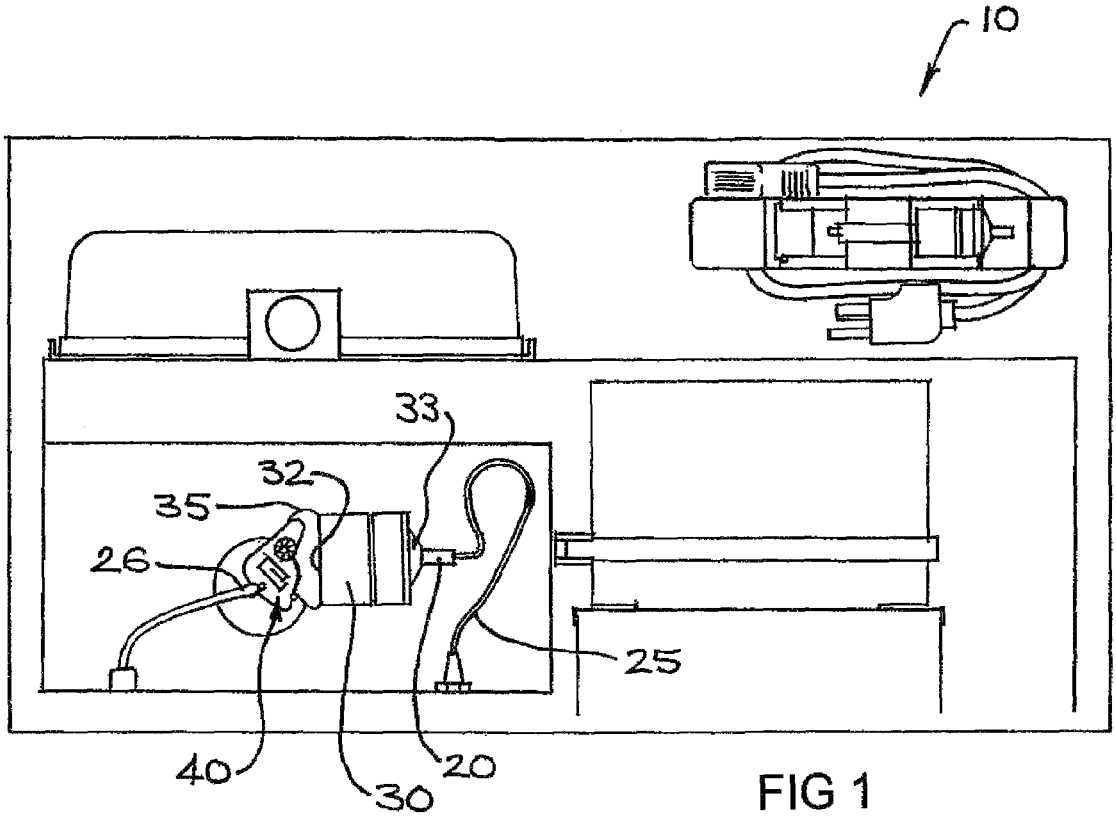
FIG. 1 is a top view of a standardised test box hearing aid tester that includes a hearing aid connected via putty to a coupler of the hearing aid tester.
Figure 2:
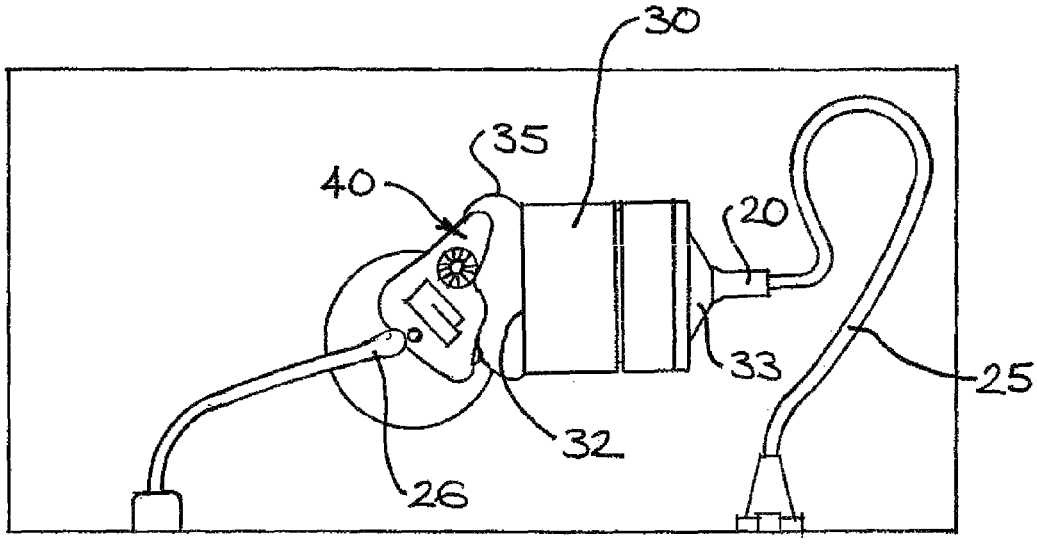
FIG. 2 is a top view of a test box of a hearing aid tester that includes a hearing aid connected via putty to a coupler of the hearing aid tester.
Figure 4:
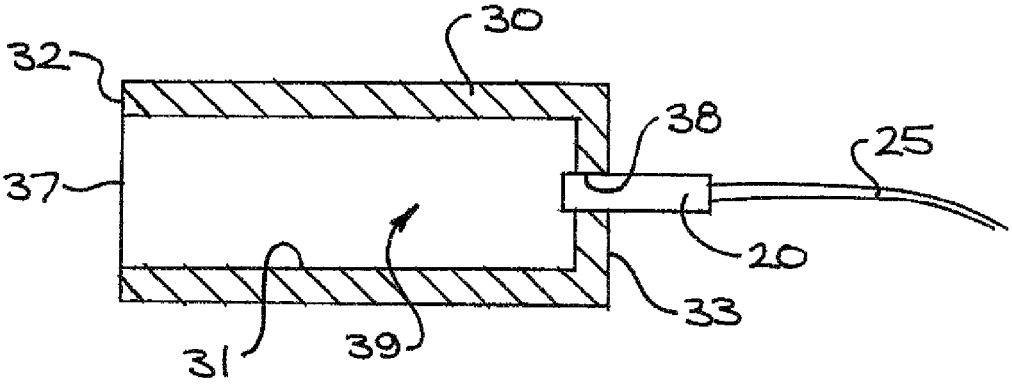
FIG. 4 shows a side view of a cross section of a 2-$cm^3$ (2 cc) metal coupler.

In FIGS. 1, 2 and 4 there is shown a standardised test box hearing aid tester 10 that includes a microphone 20 connected via a cable 25 to the tester 10 at one end and to a 2-$cm^3$ (2 cc) metal coupler 30 at the other end. An In-The-Ear (ITE) type hearing aid 40, which is shown in more detail in FIG. 2, is connected to the coupler 30 using pliable adhesive putty 35, which is the means used, prior to the present invention, to connect the hearing aid 40 to the coupler 30.

Figure 11:
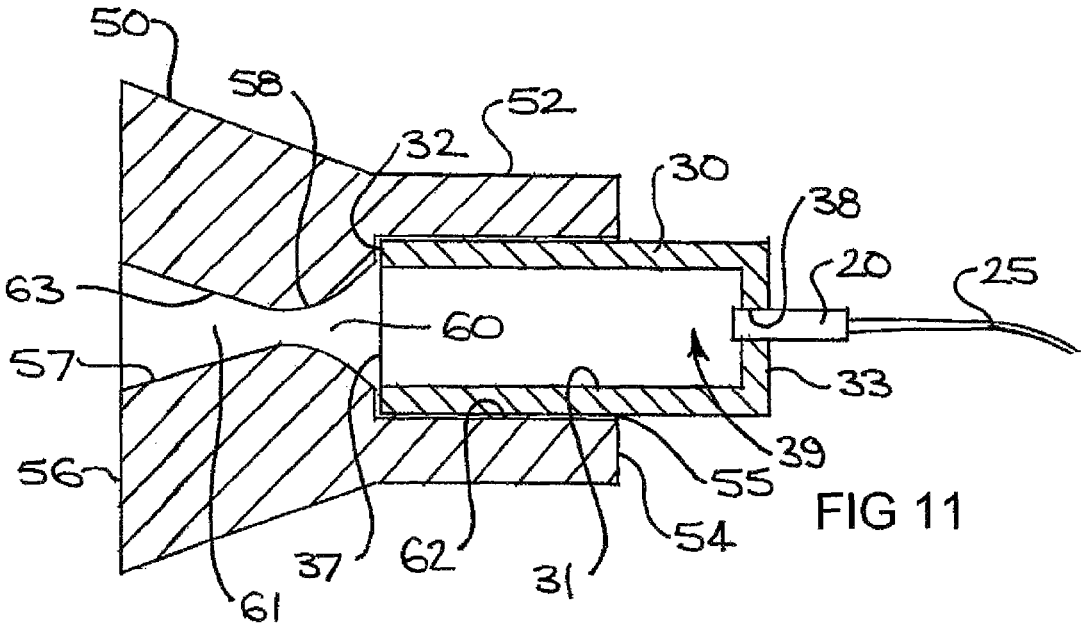
FIG. 11 is a section view of the apparatus of FIG. 4 connected to a 2-$cm^3$ metal coupler which has a microphone and cable attached.

As shown in FIGS. 4 and 11, the coupler 30 is typically a hollow metal object having a 2-$cm^3$ internal void volume 39 designed to simulate the internal volume of an ear canal. It will be appreciated, however, that any other equivalent device that simulates an ear canal and ear drums may be used instead of the 2-$cm^3$ (2 cc) metal coupler 30. Nonetheless, for the purposes of the describing the invention reference will be made to the 2-$cm^3$ (2 cc) metal coupler 30, however, where reference is made to the 2-$cm^3$ (2 cc) metal coupler 30 any other equivalent device that simulates an ear canal and ear drums may be substituted. The coupler 30 typically has an internal cylindrical or rectangular prism shaped surface 31 defining the internal void volume 39. At one end of the coupler 30, a hearing aid receiving end 32, there is a typically larger sized opening 37 to the internal void volume 39 that is typically adapted to receive the hearing aid 40. At typically the opposite end of the coupler 30, a microphone receiving end 33, there is typically a smaller sized opening 38 to the internal void volume 39 that is adapted to receive the microphone 20 of the tester 10.

Figure 3:
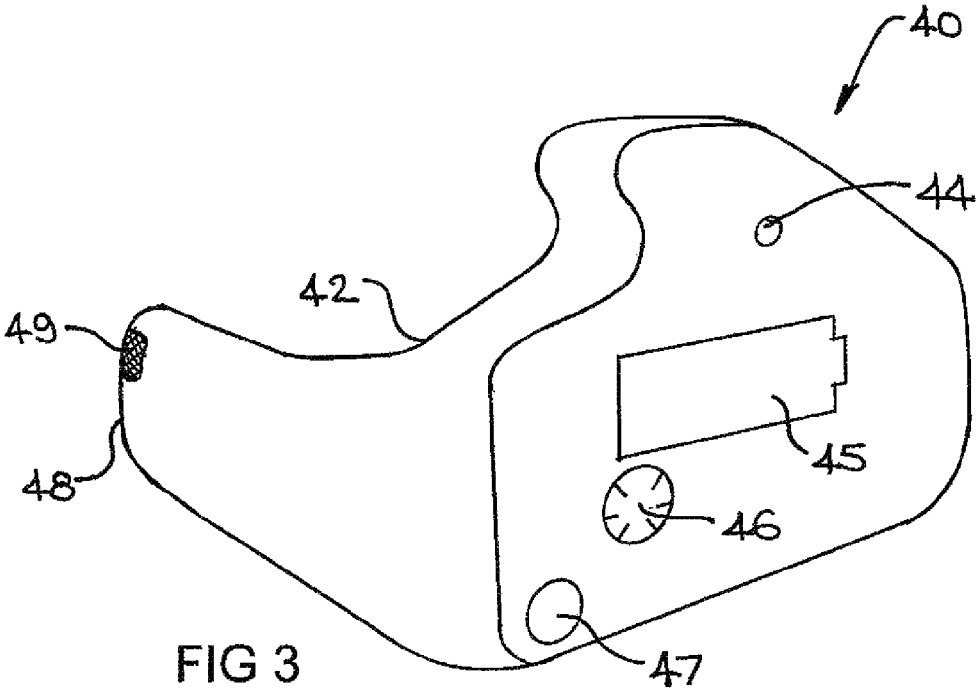
FIG. 3 is a perspective view of an In-The-Ear (ITE) type hearing aid of the type that the apparatus of the invention is adapted to connect to a 2-$cm^3$ (2 cc) metal coupler of a hearing aid tester.

In FIG. 3, an In The Ear (ITE) type hearing aid 40 is shown that includes a housing 42 that is shaped to conform to the inner surface of a concha and part of the ear canal. The hearing aid also includes a microphone portion 44, a battery door 45, volume control 46 and vent 47 located on a planar surface 41 that is exposed when the hearing aid 40 is inserted in the concha and the ear canal. The end 48 of the housing 42 opposite to the planar surface 41 is inserted into the ear canal. Located on the end 48 is a receiver portion 49 that includes a loudspeaker that emits amplified sound that is picked up by the microphone portion 44. Accordingly, the housing 42 in the region of the end 48 is a sound emitting portion of the hearing aid 40 that fits into an ear canal or concha.

Figure 5:
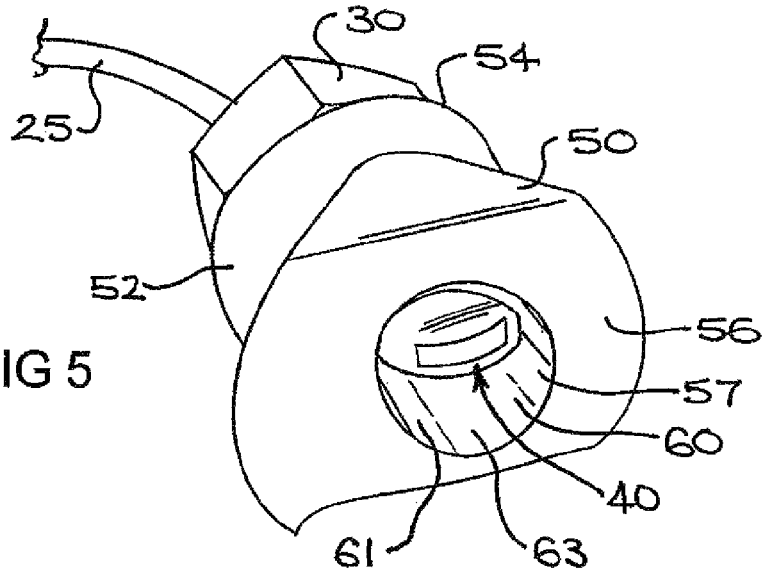
FIG. 5 is a perspective view of a apparatus in accordance with a preferred form of the invention showing details of the rear end of the apparatus receiving a hearing aid and the front end of the apparatus connected to a 2-$cm^3$ metal coupler.
Figure 10:
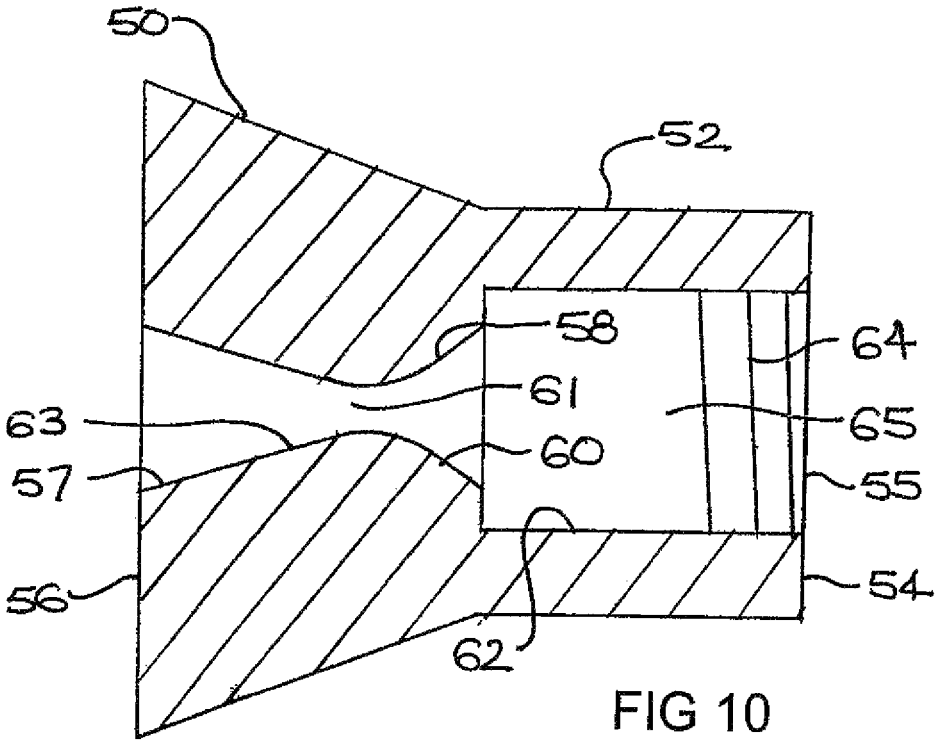
FIG. 10 is a side cross-section view of the apparatus of FIG. 4 without a hearing aid fitted.

Prior to the present invention, testing the In-The-Ear (ITE) type hearing aid 40 shown in an ear in FIG. 10 and the In-The-Canal (ITC) type hearing aid 40 shown in an ear in FIG. 11 using the arrangement of FIGS. 1 and 2 involved shaping pliable adhesive putty 35 around the housing 42 of the hearing aid 40 and inserting the sound emitting portion of the hearing aid 40 into the opening 37 at the hearing aid receiving end 32 of the coupler 30. The person conducting the test needed to ensure that the putty 35 was applied to the sound emitting portion of the housing 42 and the coupler 30 in a manner that provided a seal between the sound emitting portion of the housing 42 and the opening 37 at the hearing aid receiving end 32 of the coupler 30. The person also needed to ensure that the receiver portion 49 was located at a predetermined position relative to the internal void volume 39 of the coupler 30 and that no putty 35 encroached into the internal void volume 39 of the coupler 30. The microphone 20 of the tester 10 is inserted into the opening 38 at the microphone receiving end 33 of the coupler 30 to measure amplified sound generated by the receiver portion 49 of the hearing aid 40. As shown in FIGS. 1, 2 and 5 the hearing aid 40, or at least the sound emitting portion of the hearing aid 40, and the coupler 30 are then set down in a predetermined location in a test box 15 of the tester 10. A reference microphone 26 of the tester 10 is then located at a predetermined position relative to the microphone portion 44 of the hearing aid 40. A lid of the test box 15 is then closed and sealed so that tests of the performance of the hearing aid 40 such as frequency response, gain, and maximum output can be conducted.

FIGS. 2 and 4 show the standardised test box hearing aid tester 10 that includes the microphone 20 connected via a cable 25 to the measuring apparatus 10 at one end and to the 2-$cm^3$ (2 cc) metal coupler 30 at the other end. An In-The-Ear (ITE) type hearing aid 40, which is shown in more detail in FIG. 2, is connected to the coupler 30. However, instead of using the pliable adhesive putty 35 shown in FIGS. 1 and 2, which is the means presently used to connect the hearing aid 40 to the coupler 30, an apparatus 50 as shown in FIGS. 5 to 12 is used.

The apparatus 50 is shown in greater detail in FIGS. 6, 7, 8, 9, 10, 11 and 12 and includes an elongate body 52 having a front end 54 and a rear end 56. A front end opening 55 is provided at the front end 54 while a rear end opening 57 is provided at the rear end 56. A passage 58 defined within the elongate body 52 by an internal surface 60 extends between the front end opening 55 and the rear end opening 57. The passage 58 has a section 61 immediately adjacent the rear end 56 of the apparatus 50 for receiving the sound emitting portion of the of the hearing aid 40. The sound emitting portion receiving section 61 is defined by a resilient surface 63 forming part of the internal surface 60. Part or all of the surface 63 may be resilient. The resilient surface 63 may be integral or may be provided by a resilient insert placed within the sound emitting portion receiving section 61 of the passage 58. The passage 58 also has a 2-$cm^3$ coupler receiving section 65 immediately adjacent the front end 54 of the apparatus 50. The coupler receiving section 65 is defined, in a preferred form, by a cylindrical surface 62 forming part of the internal surface 60.

Figure 6:
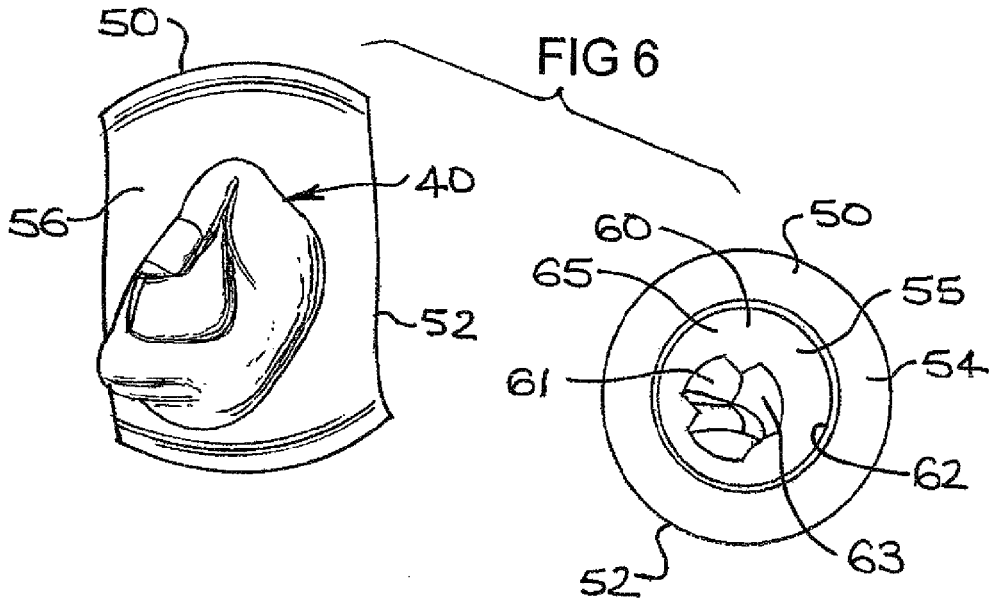
FIG. 6 is a top view of two of the apparatus' of FIG. 4 showing details of the rear end of one apparatus receiving a hearing aid and details of the front end of another apparatus adapted to connect to a 2-$cm^3$ metal coupler.
Figure 7:
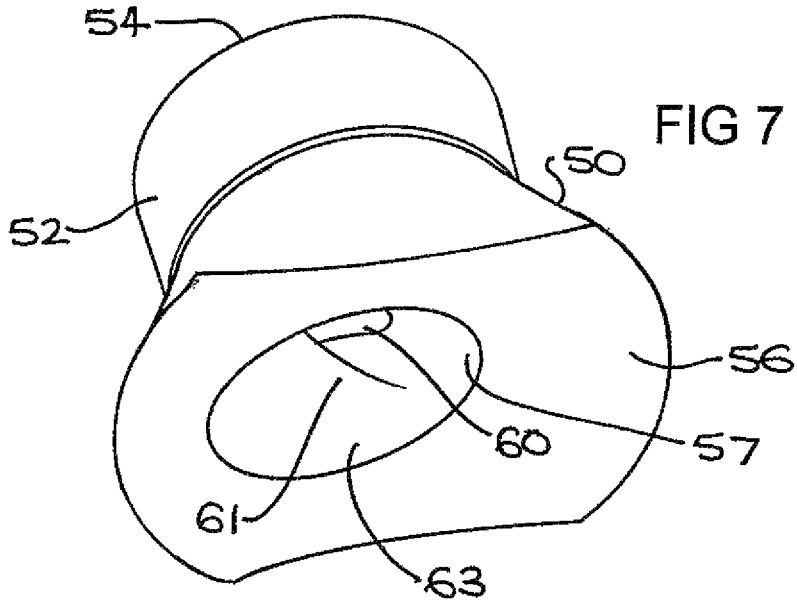
FIG. 7 is a perspective, view of the apparatus of FIG. 4 showing details of the rear end adapted to receive a hearing aid.
Figure 8:
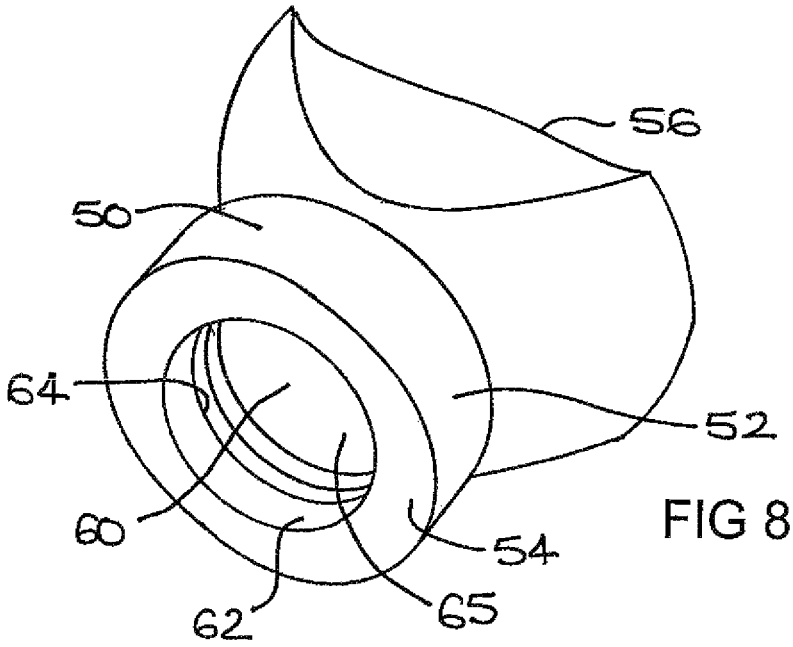
FIG. 8 is a perspective view of the apparatus of FIG. 4 showing details of the front end adapted to connect to a 2-$cm^3$ metal coupler.
Figure 9:
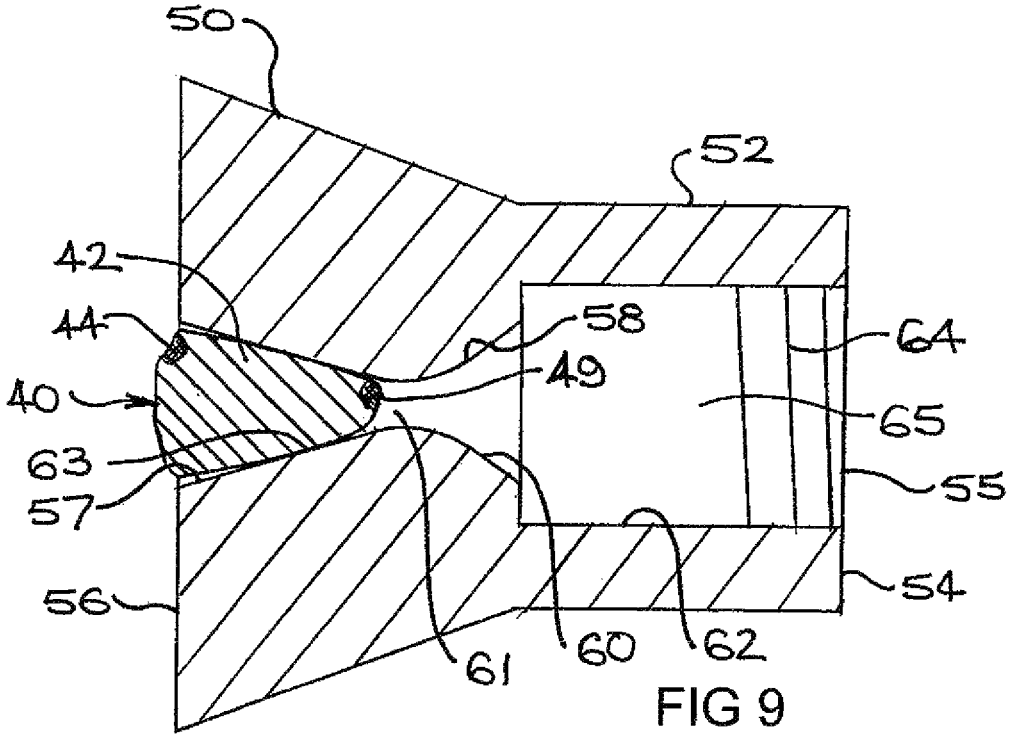
FIG. 9 is a side cross-section view of the apparatus of FIG. 4 and a hearing aid fitted.

As shown in FIG. 11, the front end 54 of the elongate body 52 is adapted to connect to the 2-$cm^3$ (2 cc) metal coupler 30 of the hearing aid tester 10 by way of receiving the hearing aid receiving end 32 of the coupler 30 within the coupler receiving section 65 of the passage 58 immediately adjacent the front end 54 of the apparatus 50. As shown in FIGS. 5, 6 and 9 the sound emitting portion receiving section 61 of the passage 58 receives and securely retains a hearing aid housing 42 therewithin. In the case of In The Ear (ITE) or In The Canal (ITC) type hearing aids 40, when the sound emitting portion of the housing 42 is received within sound emitting portion receiving section 61 of the passage 58 the receiver portion 49 of the hearing aid 40 is located closer to the front end opening 55 relative to the microphone portion 44 of the hearing aid 40.

The resilient surface 63 and the cylindrical surface 62, which respectively define the sound emitting portion receiving section 61 and the coupler receiving section 65 of the passage 58, may be partially or completely formed from a material that is resiliently deformable. However, at least part of the resilient surface 63 defining the sound emitting portion receiving section 61 is partially or completely formed from a material that is resiliently deformable such that at least part of the resilient surface 63 deforms to the shape of the sound emitting portion of the hearing aid housing 42 when it is inserted into the sound emitting portion receiving section 61 of the passage 58 through the rear end opening 57. When the resilient surface 63 deforms to the shape of the sound emitting portion of the hearing aid housing 42 it compresses the sound emitting portion of the hearing aid housing 42 to retain it snugly within the sound emitting portion receiving section 61 of the passage 58 by way of friction between the resilient surface 63 and the sound emitting portion of the hearing aid housing 42. The resilient surface 63 may be integrally formed with the body 52 or may be provided by a resilient insert placed within the sound emitting portion receiving section 61 of the passage 58 or a sheath or sleeve for the sound emitting portion of the hearing aid housing 42 placed within the sound emitting portion receiving section 61 of the passage 58.

The apparatus 50 is arranged so as to receive and securely retain the sound emitting portion of the hearing aid housing 42 within the passage 58 such that the receiver portion 49 of the hearing aid 40 is located towards the front end opening 55 in a substantially predetermined location relative to the front end opening 55 and to the metal coupler 30 when the apparatus 50 is connected to the metal coupler 30. This is particularly important for enabling the hearing aid tester 10 to provide accurate test results when the hearing aid 40 is tested.

In the case of the In-The-Ear (ITE) and the In-The-Canal (ITC) type hearing aids 40 the apparatus 50 may receive and securely retain not only the sound emitting portion but also practically the rest of the hearing aid housing 42 within the passage 58 such that the microphone portion 44 of the hearing aid 40 is away from the front end opening 55 relative to the receiver portion 49 and in a substantially predetermined location relative to the metal coupler 30 when the apparatus 50 is connected to the metal coupler 30.

The dimensions of the resilient surface 63 defining the sound emitting portion receiving section 61 of the passage 58 may be such that the sound emitting portion of the housing 42 is received in an interference fit therewithin. However, in instances where the material forming the body 52 is resilient in nature, when the sound emitting, portion of the housing 42 is removed, the resilient surface 63 defining the sound emitting portion receiving section 61 of the passage 58 reverts to its original shape. As such, the housing 42 can be repeatedly inserted into and removed from the passage 58 without requiring any manual resetting of the shape and configuration of the passage 58 between housing 42 insertions. Thus the material used to form at least part or all of the resilient surface 63 of the sound emitting portion receiving section 61 of the passage 58 is a material able to return to its original shape when a load is removed. The resilient surface 63 of the sound emitting portion receiving section 61 may be formed from a material including but not limited to any one or more of the following elastomers: Natural Rubber (NR), Polyisoprene (IR), Butyl rubber (copolymer of isobutylene and isoprene, IIR), Halogenated butyl rubbers (Chloro Butyl Rubber: CIIR; Bromo Butyl Rubber: BIIR), Polybutadiene (BR), Styrene-butadiene Rubber (copolymer of polystyrene and polybutadiene, SBR), Nitrile Rubber (copolymer of polybutadiene and acrylonitrile, NBR), also called buna N rubbers, Hydrated Nitrile Rubbers (HNBR) Therban® and Zetpol®, Chloroprene Rubber (CR), polychloroprene, Neoprene, Baypren etc., ethylene propylene rubber (EPM), ethylene propylene diene rubber (EPDM), Epichlorohydrin rubber (ECO), Polyacrylic rubber (ACM, ABR), Silicone rubber (SI, Q, VMQ), Fluorosilicone Rubber (FVMQ), Fluoroelastomers (FKM, FPM) Viton®, Tecnoflon®, Fluorel® and Dai-El®, Perfluoroelastomers (FFKM) Kalrez®, Polyether Block Amides (PEBA), Tetrafluoro ethylene/propylene rubbers (FEPM), Chlorosulfonated Polyethylene (CSM), (Hypalon®), Ethylene-vinyl acetate (EVA), Thermoplastic Elastomers (TPE), for example Hytrel®, Thermoplastic Vulcanizates (TPV), for example Santoprene® TPV, Polyurethane rubber, Resilin, Elastin, Polysulfide Rubber.

As mentioned above, the front end 54 of the apparatus 50 is adapted to connect to a 2-$cm^3$ (2 cc) metal coupler 30 of the hearing aid tester 10 by way of receiving the hearing aid receiving end 32 of the coupler 30 within the coupler receiving section 65 of the passage 58 immediately adjacent the front end 54 of the apparatus 50. As shown in FIGS. 5, 6 and 9 the coupler receiving section 65 of the passage 58 is defined by the substantially cylindrical portion 62 of the passage 58 located adjacent the front end opening 55 at the front end 54 of the apparatus 50. The cylindrical portion 62 of the passage 58 may be formed partially or completely from a material that is resiliently deformable and be dimensioned so as to receive the hearing aid receiving end 32 portion of the coupler 30 in an interference fit and to provide a practical seal between the cylindrical portion 62 of the passage 58 and the coupler 30. The material forming the cylindrical portion 62 of the passage 58 may be selected from the group of elastomers listed above. A thread 64 disposed on the inner circumferential surface of the cylindrical portion 62 may assist it to receive the coupler 30 by screwing the apparatus 50 onto an outer surface 34 of the coupler 30. Instead of a thread, the inner circumferential surface of the cylindrical portion 62 may include some other means for enhancing the grip with the outer surface 34 of the coupler 30 such as protrusions which may be in the form of ridges extending around the inner circumferential surface of the cylindrical portion 62.

Figure 12:
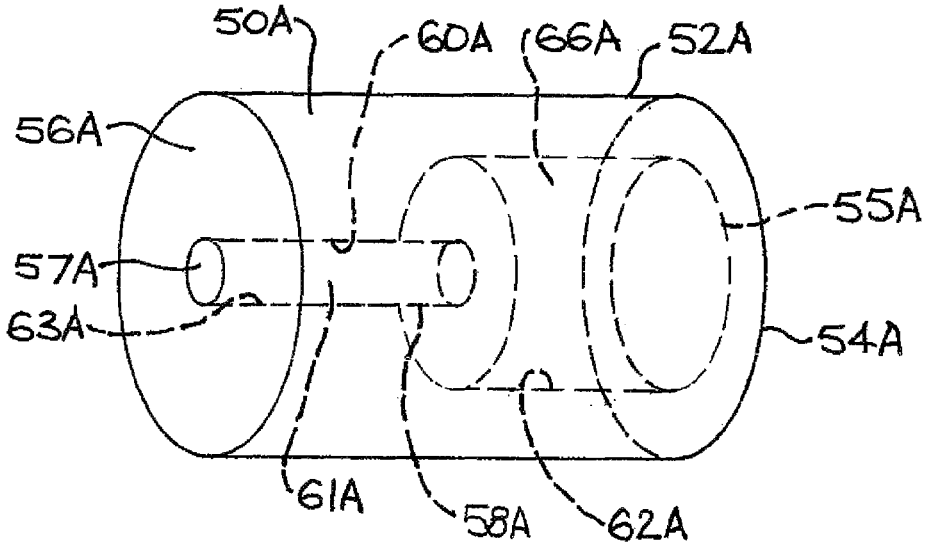
FIG. 12 is a perspective view of an apparatus in accordance with a preferred form of the invention that is suitable for use with Receiver In The Ear (RITE) and Over The Ear (OTE) hearing aids.

An embodiment of the apparatus 50A shown in FIG. 12 is particularly suitable for use with Receiver In The Ear (RITE) and Over The Ear (OTE) type hearings aids. An example of a Receiver In The Ear (RITE) hearing aid 50A is shown in FIG. 15 and includes a shell shaped body 51A containing a microphone, amplifier and power supply. However, in contrast to the In-The-Ear (ITE) and the In-The-Canal (ITC) type hearing aids, the receiver 49A is housed in a sound emitting portion 42A that is placed inside the ear canal and is connected to the body 51A by a thin cable 52A. The sound emitting portion 42A may be a small, hard acrylic, metal or other rigid material housing that encases the receiver 49A, as shown in FIG. 15, and that with the attachment of a soft silicone dome or a moulded acrylic tip, as shown in FIG. 16, holds the receiver 49A in place in the ear canal.

The apparatus 50A illustrated in FIG. 15 has many similarities to the apparatus 50 illustrated in the other Figures. It includes a passage 58A defined by an internal surface 60A extending from an opening 55A at a front end 54A to an opening 57A at a rear end 56A. The passage 58A has a sound emitting portion receiving section 61A immediately adjacent the rear end 56A defined by a resilient surface 63A forming part of the internal surface 60A. The passage 58A also has a 2-$cm^3$ coupler, or equivalent device, receiving section 65A immediately adjacent the front end 54A of the apparatus 50A. The coupler receiving section 65A is defined, in a preferred form, by a substantially cylindrical surface 62A forming part of the internal surface 60. The main difference, between the apparatus 50A illustrated in FIG. 15 and the apparatus 50 illustrated in the other Figures is that the apparatus 50A illustrated in FIG. 15 has an elongated cylindrical sound emitting portion receiving section 61A rather than the tapered sound emitting portion receiving section 61 of the apparatus 50 illustrated in the other Figures. The reason for this is that the sound emitting portion 42A containing the receiver 49A, in the Receiver In The Ear (RITE) type hearing aids in particular, may have a substantially uniform cross section or regular shape such as a substantially cylindrical shape, as illustrated in FIG. 15, and not concha or ear canal shaped sound emitting portion such as for In-The-Ear (ITE) and the In-The-Canal (ITC) type hearing aids.

Alternatively, the sound emitting portion 42A may have other regular shapes such as a rectangular shape with rounded corners or an ovoid shape. In most cases, a substantially circular cross section for the sound emitting portion receiving section 61A of the passage 58A will be suitable for use with most shapes of sound emitting portions 42A containing the receiver 49A in Receiver In The Ear (RITE) type hearing aids. However, it is to be appreciated that the sound emitting portion receiving section 61A of the passage 58A may have any suitable shape and configuration beyond those mentioned above and still be effective for achieving the purpose of the invention which is for the resilient surface 63 and 63A to deform to the shape of the sound emitting portion 42 and 42A compresses the sound emitting portion 42 and 42A to retain it snugly within the sound emitting portion receiving section 61 and 61A of the passage 58 and 58A by way of friction between the resilient surface 63 and 63A and the sound emitting portion 42 and 42A.

Referring to FIGS. 5, 6, 7, 8, 9, 10 and 11 the resilient surface 63 defining the sound emitting portion receiving section 61 of the passage 58 is formed to a shape that substantially conforms to the shape of the sound emitting portion of a standard hearing aid housing 42. Alternatively, the surface 60 may be customised to conform to the shape of the external surface of the sound emitting portion of a particularly shaped hearing aid housing 42. In accordance with another aspect of the invention the apparatus 50 may be formed by a method including a number of steps. The first step includes providing a first mould shaped like the surface of a concha or an ear canal or like the external surface of the sound emitting portion of the housing 42 of the hearing aid 40. The first mould is inserted into a second larger mould that is shaped like the elongate body of the apparatus 50. The second mould may also include a portion that is shaped like the cylindrical portion 62 of the passage 58. The space between the first mould and the second mould is filled with flowable material that hardens to form a resiliently deformable material. When the material hardens and the moulds are removed the apparatus 50 according to a preferred form of the invention is formed.

The step of providing the first mould may include taking a cast of the shape of a concha or an ear canal or like the shape of the external surface of the sound emitting portion of the housing 42 of an individual hearing aid 40 and using the cast to form the first mould.

The step of inserting the first mould into the second mould includes shaping the second mould so that the resilient surface 63 defining the sound emitting portion receiving section 61 of the passage 58 is adapted to retain the sound emitting portion of the hearing aid housing 42, which may include the receiver portion 49, at a predetermined location and orientation relative to the metal coupler 30 of the hearing aid tester 10. Also, it is advantageous for the second mould to be shaped such that the apparatus is adapted to retain the microphone portion 44 of the hearing aid 40 at a predetermined location and orientation relative to the metal coupler 30 of the hearing aid tester 10. Furthermore, the internal dimensions of the second mould ought to be such that the moulded apparatus 50 will fit within the test box 15 of the hearing aid tester 10.

Although the embodiments of the invention described above relate to an apparatus 50 comprised of an elongate body 52 that is formed with an internal passage 58 defined by a surface 60 that is at least partly resilient, it is to be appreciated that the apparatus 50 may not be formed as a single integral component. For example, the apparatus may include a passage 58 including a sound emitting portion receiving section 61 and a resilient insert, sheath or cover, separate from the elongate body 52, which may be inserted into the sound emitting portion receiving section 61 or placed on or over the sound emitting portion of the hearing aid 40 and then inserted into the sound emitting portion receiving section 61. Thus, the resilient insert, sheath or cover is compressed between the portion of the surface 60 defining the sound emitting portion receiving section 61, which may not be resilient, and the sound emitting portion of the hearing aid 40 thereby securely retaining the sound emitting portion within the passage. It will be appreciated that such arrangements would constitute an embodiment of the inventive concept described and illustrated herein.

In further embodiments of the invention, the 2-$cm^3$ coupler 30 may be integrally formed with the apparatus 50. In such arrangements, the coupler receiving section 65 of the passage 58 immediately adjacent the front end 54 of the apparatus 50 may be arranged to function as the 2-$cm^3$ internal void volume 39 of the coupler 30. In such an arrangement, the front end opening 55 of the apparatus 50 may be function as the smaller sized opening 38 at the microphone receiving end 33 of the coupler 30 and be adapted to receive the microphone 20 of the tester 10. Accordingly, the coupler receiving section 65 of the passage 58 immediately adjacent the front end 54 of the apparatus 50 may be designed to simulate the internal volume of an ear canal.

It will be apparent from the foregoing description that an apparatus 50 incorporating the invention will include a component that has resilient properties that are operable for receiving and securely retaining a sound emitting portion of a hearing aid 40, which fits into the concha or ear canal of the user, relative to a metal coupler 30 of a hearing aid tester 10 in a position that is substantially predeterminable and reproducible upon subsequent insertions of the sound emitting portion of the hearing aid 40 into the apparatus 50. It will also be apparent that an apparatus 50 incorporating the invention will provide a substantial and valuable improvement over existing means of retaining the sound emitting portion of a hearing aid 40 relative to a metal coupler 30 of a hearing aid tester 10, of which an example is the use of pliable putty.

Finally it is to be understood that various alterations, modifications and/or additions may be introduced into the constructions and arrangements of the parts previously described without departing from the spirit or ambit of the invention.

The invention claimed is:

1. A method of testing a hearing aid having a sound emitting portion that fits into the concha or ear canal of a user, the method including the steps of: providing an apparatus including: a body having a front end, a rear end and an intermediate portion; a passage extending in an axial direction through the body from the front end to the rear end, the passage including a hearing aid tester receiving section immediately adjacent the front end of the body for receiving a hearing aid tester within the passage and a sound emitting portion receiving section immediately adjacent the rear end of the body for receiving the sound emitting portion of a hearing aid; and a resilient surface within the passage that resiliently deforms when the sound emitting portion is received in the passage for retaining the sound emitting portion in the passage wherein the intermediate portion is configured to maintain alignment of the hearing aid tester receiving section and the sound emitting portion receiving section of the passage to thereby maintain the sound emitting portion of the hearing aid received within the sound emitting portion receiving section in a substantially predetermined orientation relative to the hearing aid tester received within the hearing aid tester receiving section; inserting the sound emitting portion in the passage; and connecting the opening near the front end to the hearing aid tester.

2. An apparatus for connecting a hearing aid tester to a sound emitting portion of a hearing aid that fits into the concha or ear canal of a user, the apparatus including: a body having a front end, a rear end and an intermediate portion; a passage extending in an axial direction through the body from the front end to the rear end, the passage including a hearing aid tester receiving section immediately adjacent the front end of the body for receiving a hearing aid tester within the passage and a sound emitting portion receiving portion immediately adjacent the rear end of the body for receiving the sound emitting portion of a hearing aid, and a resilient surface within the passage that resiliently deforms when the sound emitting portion is received in the passage for retaining the sound emitting portion in the passage, wherein the intermediate portion is configured to maintain alignment of the hearing aid tester receiving section and the sound emitting portion receiving section of the passage to thereby maintain the sound emitting portion of the hearing aid received within the sound emitting portion receiving section in a substantially predetermined orientation relative to the hearing aid tester received within the hearing aid tester receiving section.

3. The apparatus of claim 2, wherein the sound emitting portion receiving section is partially defined by the resilient surface.

4. The apparatus of claim 2, wherein the sound emitting portion receiving section of the passage is dimensioned to receive the sound emitting portion in interference fit.

5. The apparatus of claim 2, wherein the resilient surface is integral with the sound emitting portion receiving section of the passage.

6. The apparatus of claim 2, wherein a resilient insert within the passage resiliently deforms when the sound emitting portion is received in the passage.

7. The apparatus of claim 2, wherein the sound emitting portion receiving section of the passage is shaped like the internal surface of a concha or ear canal for receiving the sound emitting portion of any one or more of In The Ear (ITE), In The Canal (ITC), Mini Canal (MC), Completely In Canal (CIC) and Behind The Ear (BTE) type hearing aids.

8. The apparatus of claim 2, wherein the sound emitting portion receiving section of the passage is shaped for receiving the sound emitting portion of either or both of Receiver In The Ear (RITE) and Over The Ear (OTE) type hearing aids.

9. The apparatus of claim 2, wherein the hearing aid tester includes an ear volume simulating device and the passage includes a simulating device receiving section immediately adjacent the front end of the body for receiving the simulating device in the passage.

10. The apparatus of claim 9, further including a resilient surface within the simulating device receiving section of the passage that resiliently deforms when the simulating device is received in the passage for retaining the simulating device in the passage.

11. The apparatus of claim 2, wherein the passage includes an ear volume simulating section immediately adjacent the front end of the body, the simulating section of the passage having an internal void volume for simulating a void volume of an ear.

12. The apparatus of claim 11, wherein the simulating section includes a 2 cc coupler.

13. The apparatus of claim 2, wherein the passage is defined by a resilient surface extending from the opening near the front end to the opening near the rear end.

14. The apparatus of claim 2, wherein the body is formed from a resilient material.

15. The apparatus of claim 2, wherein the sound emitting portion receiving section of the passage is shaped to conform to the shape of the sound emitting portion of the hearing aid.

16. The apparatus of claim 2, wherein the sound emitting portion receiving section of the passage provides a practical seal between the sound emitting portion and the hearing aid tester.

17. The apparatus of claim 2 wherein the intermediate portion of the body is structurally rigid relative to the front end and the rear end of the body for maintaining axial alignment of the hearing aid tester receiving section and the sound emitting portion receiving section of the passage.

18. The apparatus of claim 2 wherein the body includes a wall axially surrounding the passage between the front end and the rear end of the body that has a thickness that is not uniform in the axial direction between the front end and the rear end of the body.

19. The apparatus of claim 2 further including a shoulder within the passage for abutting with the hearing aid tester to limit the extent of insertion of the hearing aid tester within the hearing aid tester receiving section of the passage.

20. The apparatus of claim 19 wherein the shoulder is substantially transverse to the axial direction.

21. The apparatus of claim 2 wherein the hearing aid tester receiving section of the passage has a minimum transverse dimension that is substantially equivalent to an external transverse dimension of an ear volume simulating device.

22. The apparatus of claim 21 wherein the hearing aid tester receiving section of the passage has a minimum transverse dimension of at least about 15 mm.

* * * * *

UNITED STATES PATENT AND TRADEMARK OFFICE

CERTIFICATE OF CORRECTION

PATENT NO. : 8,467,537 B2
APPLICATION NO. : 12/227662
DATED : June 18, 2013
INVENTOR(S) : Douglas Lloyd and Matthew Callaway It is certified that error appears in the above-identified patent and that said Letters Patent is hereby corrected as shown below:

On the Title Page

Item (75), delete "Ballaral" and insert therefor --Ballarat--.

In the Claims

Column 13, line 13 delete "portion" (second occurrence) and insert therefor --section--.

Signed and Sealed this
Seventh Day of April, 2015

Michelle K. Lee

Michelle K. Lee
*Director of the United States Patent and Trademark Office*